US010054887B2

(12) United States Patent
Matsuno

(10) Patent No.: US 10,054,887 B2
(45) Date of Patent: Aug. 21, 2018

(54) IMAGE FORMING APPARATUS HAVING AN ID SENSOR

(71) Applicant: KYOCERA Document Solutions Inc., Osaka (JP)

(72) Inventor: Akinori Matsuno, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/623,858

(22) Filed: Jun. 15, 2017

(65) Prior Publication Data

US 2017/0364013 A1 Dec. 21, 2017

(30) Foreign Application Priority Data

Jun. 16, 2016 (JP) ..... 2016-120306

(51) Int. Cl.
*G03G 15/00* (2006.01)

(52) U.S. Cl.
CPC ..... *G03G 15/5054* (2013.01)

(58) Field of Classification Search
CPC ..... G03G 15/5054; G03G 15/5058; G03G 2215/00042
USPC ..... 399/64, 74
See application file for complete search history.

(56) References Cited

U.S. PATENT DOCUMENTS

2004/0251435 A1* 12/2004 Sawayama ..... G01N 21/55 250/559.16
2012/0051770 A1* 3/2012 Sasaki ..... G03G 15/5058 399/49
2013/0243466 A1* 9/2013 Taishi ..... G03G 15/5025 399/74

FOREIGN PATENT DOCUMENTS

JP 2009-58918 3/2009
JP 2010-122552 6/2010

* cited by examiner

*Primary Examiner* — Sandra Brase
(74) *Attorney, Agent, or Firm* — Wenderoth, Lind & Ponack, L.L.P.

(57) ABSTRACT

An image forming apparatus includes an ID sensor arranged to face an intermediate transfer belt, and a board provided with the ID sensor. The ID sensor is integrally formed with the board and while emitting light toward the intermediate transfer belt, the ID sensor includes a sensor body that individually receives light regularly reflected and light diffused and reflected by the intermediate transfer belt, a lens that is arranged between the sensor body and the intermediate transfer belt to control emitted light from the sensor body and incident light to the sensor body, and a holding member that holds the lens. The holding member is directly welded and fixed to the board.

2 Claims, 10 Drawing Sheets

IMAGE FORMING APPARATUS HAVING AN ID SENSOR

CROSS-REFERENCE TO RELATED APPLICATION

This application is based upon and claims the benefit of priority from Japanese Patent Application No. 2016-120306 filed on Jun. 16, 2016, the entire contents of which are incorporated herein by reference.

BACKGROUND

The technology of the present disclosure relates to an image forming apparatus that forms a color image by using a plurality of image carrying members.

In the related art, there has been known an image forming apparatus that forms a color image by using a plurality of image carrying members. In this type of image forming apparatus, toner images formed on the plurality of image carrying members are transferred onto an intermediate transfer belt and the toner images transferred onto the intermediate transfer belt are transferred onto a transfer material, so that the color image is formed.

In this type of image forming apparatus, it is necessary to form the toner images on the intermediate transfer belt with a constant concentration. Therefore, an ID sensor is used in order to detect the concentration of the toner images on the intermediate transfer belt. The ID sensor emits inspection light toward the intermediate transfer belt, and detects the concentration of the toner images on the intermediate transfer belt on the basis of a light receiving amount of the inspection light reflected by the intermediate transfer belt.

In this type of image forming apparatus, an ID sensor 80 is provided to a board 81 as illustrated in FIG. 11. As illustrated in FIG. 12, in the ID sensor 80, a sensor body 82 having a light emitting unit 91 and a light receiving unit 92 is integrally formed with the board 81. A lens 83 is held to a holding member 84, which is mounted to the board 81, to control emitted light from the sensor body 82 and incident light to the sensor body 82. In FIG. 11, a lid member 85 forming a box body provided therein with the holding member 84 and the sensor body 82 is mounted to the board 81 from an opposite side of the holding member 84.

When the holding member 84 and the lid member 85 are mounted to the board 81, for example, two pins (bosses) 86 of the holding member 84 are allowed to be inserted into through holes 81*a* of the board 81 as illustrated in FIG. 13, and the two pins 86 are allowed to be inserted into through holes 85*a* of the lid member 85 as illustrated in FIG. 14. In this state, a distal end portion of each pin 86 is melted and is welded to the lid member 85. In this way, the holding member 84 is directly welded and fixed to the lid member 85. By this welding and fixing, the ID sensor 80 is mounted to the board 81.

SUMMARY

An image forming apparatus according to the present invention includes a plurality of rotational image carrying members and an intermediate transfer belt. The intermediate transfer belt rotates in a state of abutting on each of the aforementioned plurality of image carrying members. The image forming apparatus transfers a toner image formed on a surface of each of the aforementioned plurality of image carrying members onto the intermediate transfer belt and transfers the toner image transferred onto the intermediate transfer belt onto a transfer material, thereby forming a color image.

The aforementioned image forming apparatus includes an ID sensor arranged to face an intermediate transfer belt, and a board provided with the ID sensor. The ID sensor is integrally formed with the board. The ID sensor includes a sensor body, a lens, and a holding member. The sensor body emits light toward the intermediate transfer belt and individually receives light regularly reflected and light diffused and reflected by the intermediate transfer belt. The lens is arranged between the sensor body and the intermediate transfer belt. The lens controls emitted light from the sensor body and incident light to the sensor body. The holding member holds the lens. The holding member is directly welded and fixed to the board.

DETAILED DESCRIPTION

Hereinafter, an example of an embodiment will be described in detail on the basis of the drawings. It is noted that the technology of the present disclosure is not limited to the following embodiments.

Embodiment

Figure 1:
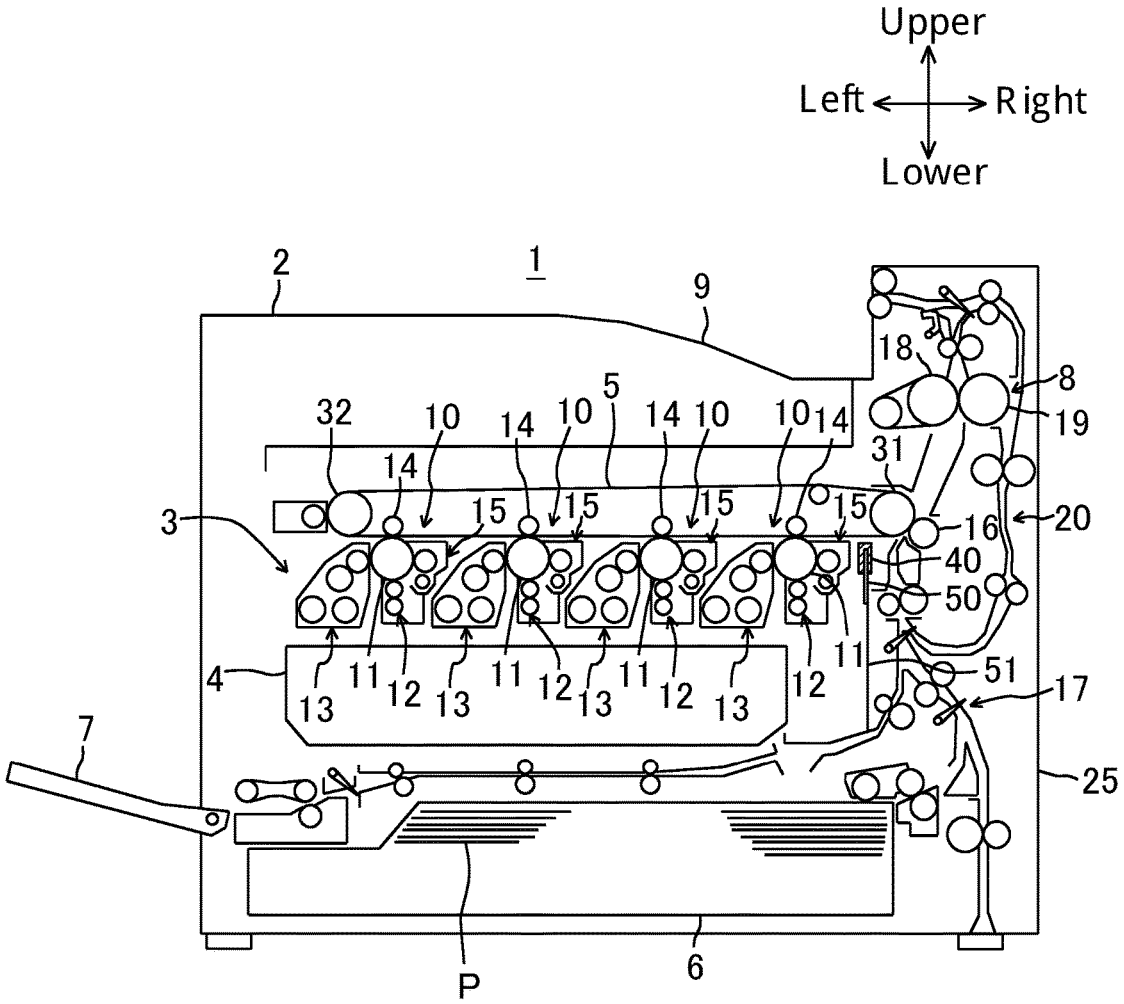
FIG. 1 is an overall view illustrating a schematic configuration of an image forming apparatus in an embodiment.

FIG. 1 illustrates a schematic configuration diagram of an image forming apparatus 1 according to an example of an embodiment. In the following description, it is assumed that a front side and a rear side indicate a front side and a rear side (a front side and a back side in a direction vertical to the sheet surface of FIG. 1) of the image forming apparatus 1, and a left side and a right side indicate a left side and a right side when the image forming apparatus 1 is viewed from the front side.

The image forming apparatus 1 is a tandem type color printer and has an image forming apparatus body 2 covered by a box-like casing 25. The image forming apparatus body 2 is provided therein with an image forming unit 3. The image forming unit 3 transfers an image onto a recording sheet P (a transfer material) and forms the image on the recording sheet P on the basis of image data transmitted from an external device such as a computer subjected to network connection and the like. Below the image forming unit 3, an optical scanning device 4 is arranged to emit laser light, and above the image forming unit 3, an intermediate transfer belt 5 is arranged to be rotationally driven so as to be abuttable on each photosensitive drum which will be described later. The intermediate transfer belt 5 is wound around a secondary transfer opposing roller 31 and a tension roller 32, and is stretched in the right and left direction between these rollers 31 and 32. Below the optical scanning device 4, a sheet storage unit 6 is arranged to store the recording sheet P, and at the left side of the sheet storage unit 6, a manual sheet feeding unit 7 is arranged. At a right upper side of the intermediate transfer belt 5, a fixing unit 8 is arranged to perform a fixing process on the image transferred onto and formed on the recording sheet P. A reference numeral 9 indicates a sheet discharge unit arranged at an upper portion of the image forming apparatus body 2 to discharge the recording sheet P subjected to the fixing process in the fixing unit 8.

The image forming unit 3 includes four image forming units 10 (four image forming units corresponding to each color of magenta, cyan, yellow, and black) arranged in a row along the intermediate transfer belt 5. Each of these image forming units 10 has a photosensitive drum 11 (an image carrying member) that is rotationally driven. Directly under each photosensitive drum 11, a charging device 12 is arranged, and at the left side of each photosensitive drum 11, a developing device 13 is arranged. Directly above each photosensitive drum 11, a primary transfer roller 14 is arranged, and at the right side of each photosensitive drum 11, a cleaning unit 15 is arranged to clean the peripheral surface of the photosensitive drum 11.

The peripheral surface of each photosensitive drum 11 is uniformly charged by the charging device 12, and laser light based on predetermined image data is irradiated to the charged peripheral surface of each photosensitive drum 11 from the optical scanning device 4, so that an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are transferred onto the intermediate transfer belt 5 by a transfer bias applied to the primary transfer roller 14.

Below the fixing unit 8, a secondary transfer roller 16 and the secondary transfer opposing roller 31 facing the secondary transfer roller 16 are arranged. The secondary transfer roller 16 is arranged next to the secondary transfer opposing roller 31 so as to abut on the secondary transfer opposing roller 31 via the intermediate transfer belt 5. The secondary transfer roller 16 abuts on the intermediate transfer belt 5. The recording sheet P conveyed through a sheet conveyance path 17 from the sheet storage unit 6 or the manual sheet feeding unit 7 is interposed by the secondary transfer roller 16 and the intermediate transfer belt 5, and the toner images on the intermediate transfer belt 5 are transferred by a transfer bias applied to the secondary transfer roller 16. On the recording sheet P, a color image is formed. In addition, in the vicinity of the secondary transfer opposing roller 31, an ID sensor 40 is provided to detect a toner concentration on the intermediate transfer belt 5. The ID sensor 40 is provided to a board 50. Details of the ID sensor 40 will be described later.

The fixing unit 8 includes a heating roller 18 and a pressure roller 19. The fixing unit 8 interposes the recording sheet P by the heating roller 18 and the pressure roller 19, and fixes the toner images, which have been transferred onto the recording sheet P, to the recording sheet P while pressing and heating the recording sheet P. The recording sheet P subjected to the fixing process is discharged to the sheet discharge unit 9. A reference numeral 20 indicates a reversing conveyance path for reversing the recording sheet P discharged from the fixing unit 8 at the time of duplex printing.

—Configuration of ID Sensor—

Figure 2:
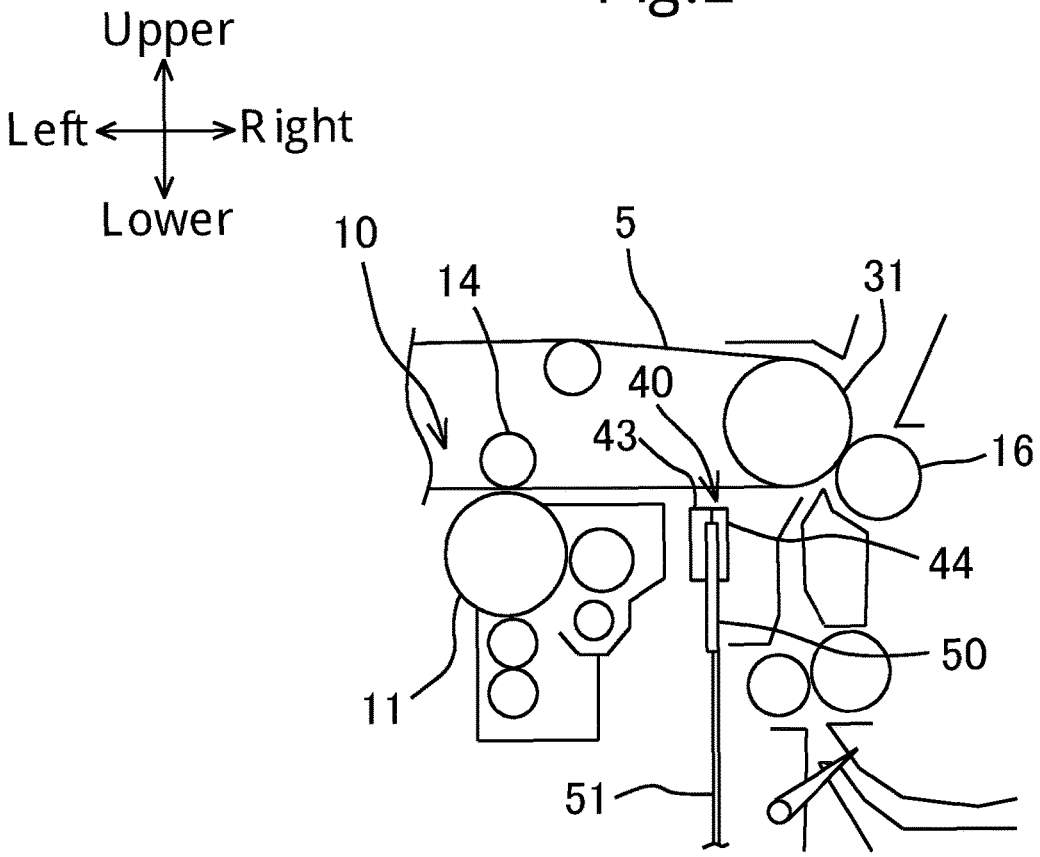
FIG. 2 is an enlarged view around an ID sensor in an image forming apparatus.

As illustrated in FIG. 2, the ID sensor 40 is arranged below the intermediate transfer belt 5 so as to face a lower part of the secondary transfer opposing roller 31 side in the intermediate transfer belt 5. The ID sensor 40 is mounted to an upper portion of the board 50 having an approximately rectangular shape. The board 50 extends in a width direction of the intermediate transfer belt 5 and is vertically erected to a facing portion in the intermediate transfer belt 5. The board 50 is fixed to a plate-like support member 51 (for example, a metal plate) integrally formed with the casing 25. The support member 51 extends in the width direction of the intermediate transfer belt 5.

Figure 3:
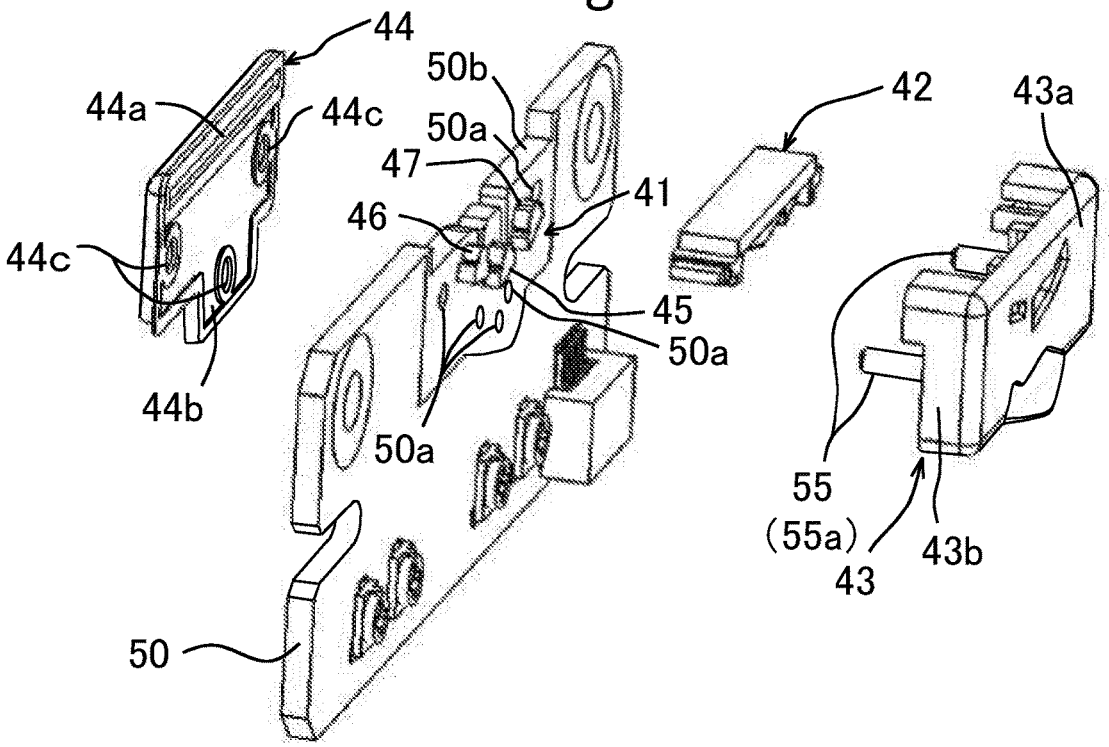
FIG. 3 is an exploded perspective view of an ID sensor.

As illustrated in FIG. 3, the ID sensor 40 includes a sensor body 41, a lens 42, a case (a holding member) 43, and a cover (a lid member) 44. The sensor body 41 includes a light emitting part 45, a first light receiving part 46, and a second light receiving part 47. The light emitting part 45, the first light receiving part 46, and the second light receiving part 47 are arranged on the same plane of the board 50 and are integrally formed with the board 50. Each optical axis of the first light receiving part 46, the light emitting part 45, and the second light receiving part 47 is approximately parallel to a front surface of the board 50. For example, the light emitting part 45 is a light emitting diode (LED) and each of the light receiving parts 46 and 47 is a photodiode (PD). In the board 50, a surface provided with the light emitting part 45 and the like is called a "front surface" and an opposite surface of the surface is called a "back surface".

Figure 4:
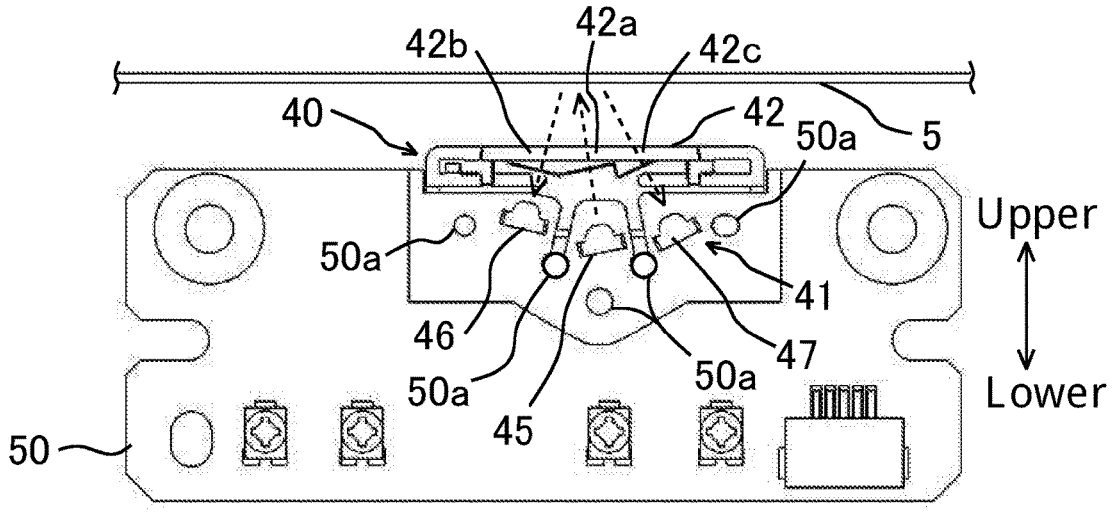
FIG. 4 is a front view of a front surface side of a board in a state in which a case has been detached.

On the front surface of the board 50, the sensor body 41 is arranged at the intermediate transfer belt 5 side (an upper side). As illustrated in FIG. 4, the first light receiving part 46, the light emitting part 45, and the second light receiving part 47 are arranged in this order from the left to the right. The light emitting part 45 is provided such that its optical axis is directed to an obliquely upper position of the first light receiving part 46 side. The first light receiving part 46 and the second light receiving part 47 are provided such that their optical axes are directed to an obliquely upper position of the light emitting part 45 side. As described above, in the case in which the light emitting part 45, the first light receiving part 46, and the second light receiving part 47 are provided, when the light emitting part 45 emits the inspection light (LED light) toward the intermediate transfer belt 5, the first light receiving part 46 receives the inspection light regularly reflected by the intermediate transfer belt 5 and the second light receiving part 47 receives the inspection light diffused and reflected by the intermediate transfer belt 5. On the basis of a light receiving amount detected by the first light receiving part 46 and a light receiving amount detected by the second light receiving part 47, the ID sensor 40 detects the concentration of the toner images formed on the intermediate transfer belt 5.

The lens 42 is an optical element that controls emitted light from the sensor body 41 and incident light to the sensor body 41. In the lens 42, a first light collecting part 42*a*, which collects emitted light of the light emitting part 45, a second light collecting part 42*b*, which collects incident light to the first light receiving part 46, and a third light collecting part 42*c*, which collects incident light to the second light receiving part 47, are integrally formed with one another. The lens 42 has an approximately rectangular shape when viewed from the top. The lens 42 is arranged between the intermediate transfer belt 5 and the sensor body 41 such that the longitudinal direction when the lens 42 is viewed from the top approximately coincides with the width direction of the intermediate transfer belt 5. In the ID sensor 40, the lens 42 faces the intermediate transfer belt 5. The lens 42 is held to the case 43.

Figure 5:
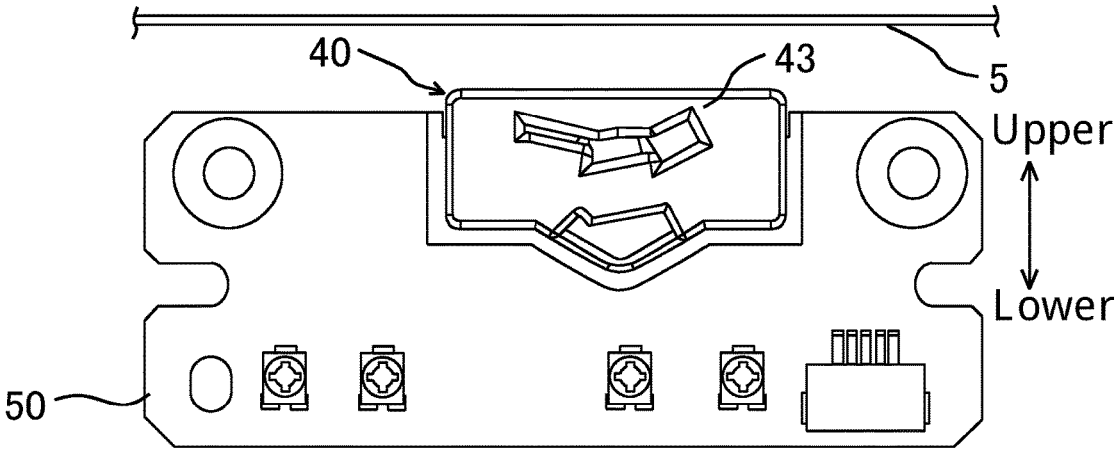
FIG. 5 is a front view of a front surface side of a board in a state in which a case has been mounted.

As illustrated in FIG. 5, the case 43 is formed in an approximately rectangular shape, in which its lower portion has slightly protruded, when viewed from the front surface side of the board 50. As illustrated in FIG. 3, in the case 43, a peripheral wall 43*b* protrudes from the periphery of a front part 43*a* and opening is formed in an upper surface of the case 43. The case 43 holds the lens 42 by allowing the lens 42 to be fitted into the opening part of the upper surface. The lens is held at a position facing a bottom surface 50*b* of a concave part of an upper end surface of the board 50. The case 43 is mounted to the board 50 to cover an upper center part, in which the sensor body 41 is arranged, in the front surface of the board 50. Furthermore, the case 43 includes a plurality of pins 55. Each pin 55 is integrally formed with the front part 43*a* and protrudes from an inner side of the front part 43*a*. In addition, the board 50 is formed with the same number of through holes 50*a* as that of the pins 55 in correspondence to the pins 55. The pins 55 and the like will be described later.

The cover 44 is a member which is arranged at an opposite side of the case 43 while interposing the board 50 between the cover 44 and the case 43 and forms a box body for receiving the sensor body 41 and the case 43 therein. As illustrated in FIG. 3, the cover 44 includes a body part 44*a* having an approximately rectangular plate shape and a protruding part 44*b* having an approximately rectangular plate shape protruding from the lower portion of the body part 44*a*. The cover 44 is formed with a plurality of through holes 44*c* in correspondence to a part of the plurality of pins 55. The height and width of the cover 44 are approximately the same as those of the case 43. The cover 44 is mounted to the board 50 from an opposite side of the case 43 to overlap the case 43 when viewed in the thickness direction of the board 50. The cover 44 serves as a lid that prevents the lens 42 from being detached from the case 43 and prevents foreign matter (toner, sheet powder and the like) from entering into the case 43 (that is, inside the ID sensor 40).

—Mounting Method of ID Sensor to Board—

As described above, the case 43 includes the plurality of pins 55. These pins 55 are metallic pins (bosses) for welding and fixing the case 43. The plurality of pins 55 include a plurality of board pins 55*a* for directly welding and fixing the case 43 to the board 50 and a plurality of cover pins 55*b* for directly welding and fixing the case 43 to the cover 44. In the present embodiment, two board pins 55*a* are provided and three cover pins 55*b* are provided.

Figure 6:
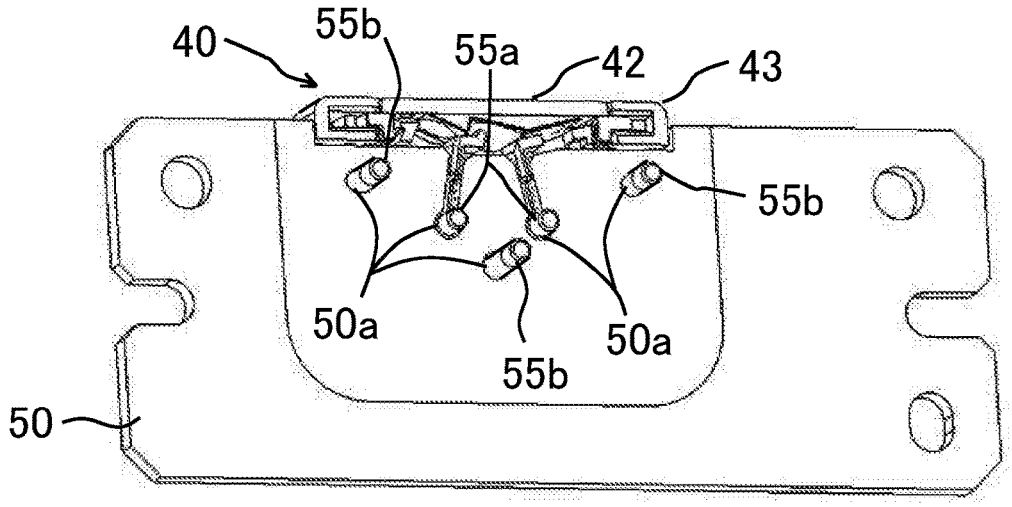
FIG. 6 is a perspective view when a board is viewed from a back surface side in a first insertion state.

When the ID sensor 40 is mounted to the board 50, all the pins 55*a* and 55*b* are allowed to be inserted into the through holes 50*a* of the board 50, resulting in a first insertion state in which the case 43 is allowed to abut on the front surface of the board 50 as illustrated in FIG. 6. FIG. 6 is a perspective view when the board 50 is viewed from a back surface side in the first insertion state. The three cover pins 55*b* are arranged to form an inverted triangle when the three cover pins 55*b* are connected to one another with lines. The two board pins 55*a* are arranged at the same height and are positioned inside of the aforementioned inverted triangle. In the first insertion state, the protruding length of the cover pin 55*b* from the back surface of the board 50 is larger than that of the board pin 55*a* from the back surface of the board 50.

In the present embodiment, in the first insertion state, the distal ends of the two board pins 55*a* are melted by a welding heater. The melted distal ends of the board pins 55*a* are attached to the board 50 and are solidified. In this way, each board pin 55*a* is welded and fixed to the board 50. The case 43 enters a first fixed state in which the case 43 is directly welded and fixed to the board 50. The case 43 is directly welded and fixed to the board 50 at two places (the two board pins 55*a*). When the welding is performed, the case 43 may be close to an upper side or a lower side such that each board pin 55*a* abuts on an upper end or a lower end of a hole surface of the through hole 50*a*.

Figure 7:
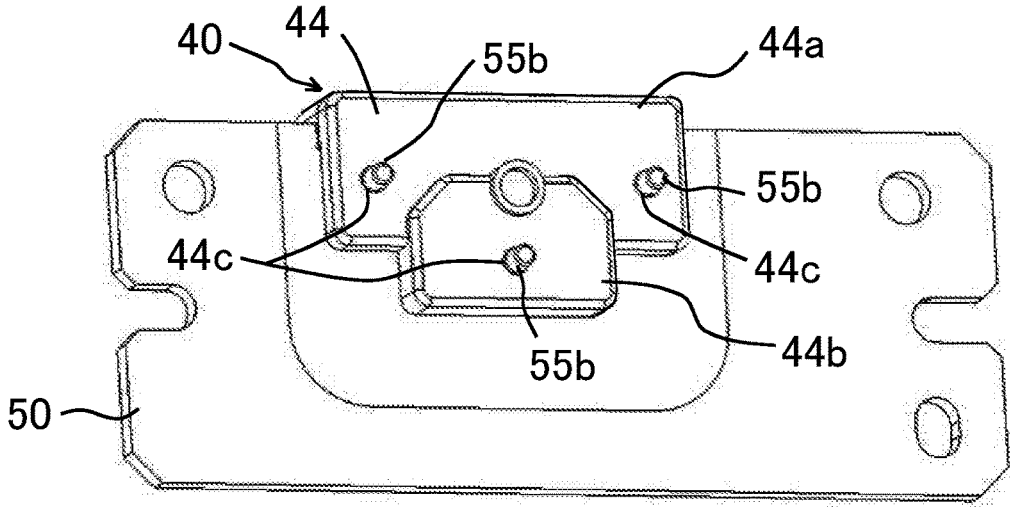
FIG. 7 is a perspective view when a board is viewed from a back surface side in a second insertion state.

As illustrated in FIG. 7, the three cover pins 55*b* are allowed to be inserted into the through holes 44*c* of the cover 44, resulting in a second insertion state in which the cover 44 is allowed to abut on the back surface of the board 50. FIG. 7 is a perspective view when the board 50 is viewed from a back surface side in the second insertion state. In the second insertion state, the three cover pins 55*b* protrude from the cover 44, so that the cover 44 abuts on the case 43 and the lens 42 with no gap. In the second insertion state, the distal ends of the three cover pins 55*b* are melted by a welding heater. The melted distal ends of the cover pins 55*b* are attached to the cover 44 and are solidified. In this way, each cover pin 55*b* is welded and fixed to the cover 44. The case 43 enters a second fixed state in which it is directly welded and fixed to the cover 44. The case 43 is directly welded and fixed to the cover 44 at three places (the three cover pins 55*b*). When the welding is performed, the cover 44 may be close to an upper side or a lower side.

As described above, the ID sensor 40 is mounted to the board 50. According to the present embodiment, the case 43 is directly welded and fixed to the board 50, so that it is possible to prevent the position of the case 43 from being changed with respect to the board 50 and to prevent a change in the positional relation between the sensor body 41 and the lens 42. Consequently, it is possible to prevent the change in the aforementioned positional relation which has an adverse influence on the detection accuracy of the ID sensor 40, so that it is possible to improve the detection accuracy of the ID sensor 40.

In the ID sensor 40, there is a variation in the performance of the light emitting part 45 and the light receiving parts 46 and 47. Therefore, after the ID sensor 40 is mounted to the board 50, the light emitting part 45 is allowed to actually emit light and confirm the light receiving sensitivity of each of the light receiving parts 46 and 47, thereby adjusting the light amount of the light emitting part 45 and the light receiving sensitivity of each of the light receiving parts 46 and 47.

Figure 8:
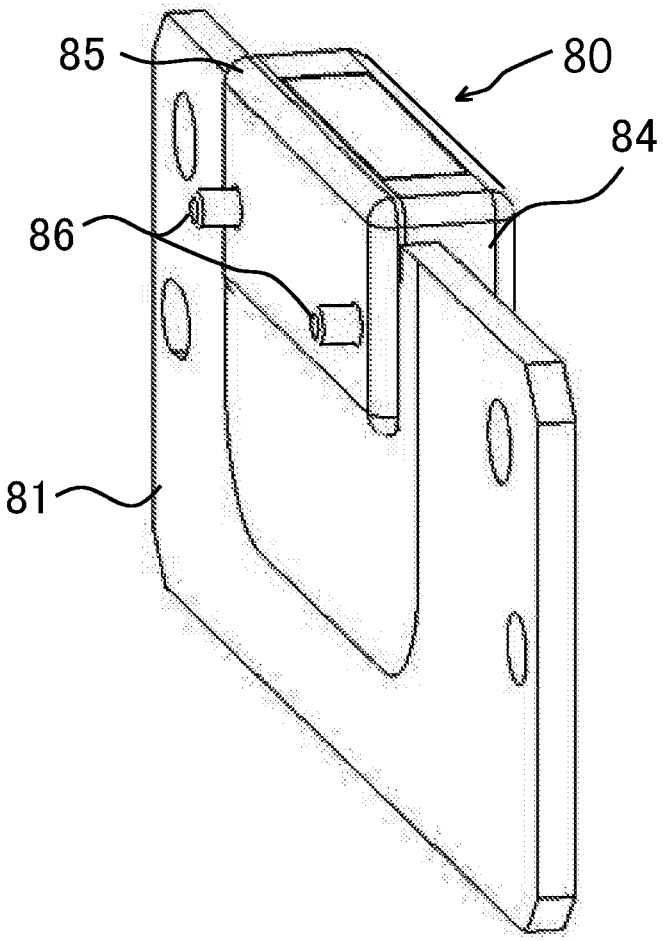
Fig.8 Prior Art
FIG. 8 is a perspective view for explaining problems of a fixing method of a cover in a related image forming apparatus.

Furthermore, in the present embodiment, the case 43 and the cover 44 are directly welded and fixed with the three cover pins 55*b*. However, in the related image forming apparatus, as illustrated in FIG. 8, the holding member 84 and the lid member 85 are directly welded and fixed with the two pins 86. Therefore, the lid member 85 may be easily inclined with respect to the holding member 84 and the board 81 and a gap may occur between the holding member 84 and the lid member 85. When the gap occurs, foreign matter enters into an interior including the sensor body 82 from the gap. However, in the present embodiment, since the case 43 and the cover 44 are directly welded and fixed with the three cover pins 55*b*, the cover 44 is not easily inclined with respect to the case 43. Therefore, it is possible to suppress a gap through which foreign matter enters. It is desired that the three cover pins 55*b* are not arranged on the same straight line.

—Positioning Method of Board—

As described above, the board 50 is fixed to the plate-like support member 51 integrally formed with the casing 25. In order to improve the detection accuracy of the ID sensor 40, it is desired that the board 50 is fixed such that the upper surface of the lens 42 is parallel to the intermediate transfer belt 5 (that is, the upper end surface of the board 50 is parallel to the intermediate transfer belt 5). In the present embodiment, in order to perform such fixing, a pair of notches 61 and a long hole 62 are formed in the board 50.

Figure 9:
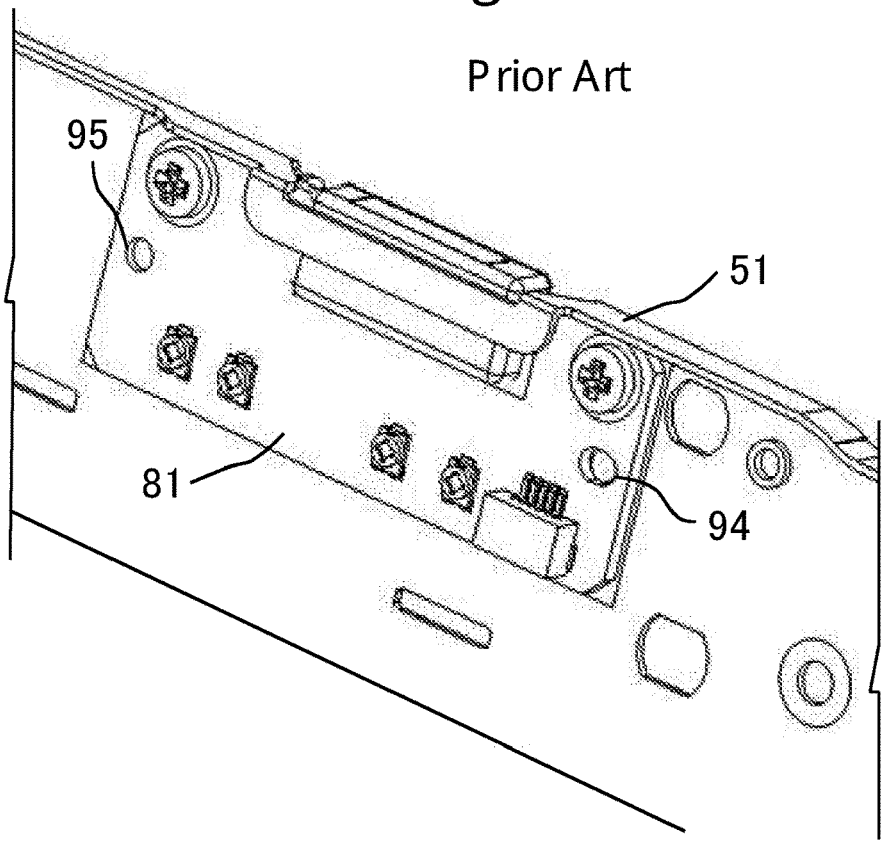
Fig.9 Prior Art
FIG. 9 is a perspective view for explaining problems of a positioning method of a board in a related image forming apparatus.

The related positioning method of the board 81 will be described. As illustrated in FIG. 9, the board 81 is formed at the vicinity of one side thereof with a long hole 94 extending in a transverse direction, and at the vicinity of the other side thereof with a round hole 95. In the case of fixing the board 81 to the support member 51, in the state in which screws have been allowed to be inserted into the long hole 94 and the round hole 95, an operator pushes down the board 81 to achieve down-shift and performs screwing. The height of the lower end of the long hole 94 and the height of the lower end of the round hole 95 are equal to each other. Therefore, by the screwing in the down-shift state, the board 81 is fixed in the state in which its upper end surface is horizontal. In the related art, a screw is put into the round hole 95, so that the transverse movement of the board 81 is restricted and the transverse positioning of the board 81 is achieved.

However, the screwing is manual work. Therefore, it is desired to be able to confirm whether the down-shift is achieved after the screwing. In the related art, it is not possible to perform the confirmation in the state in which screws have been inserted into the long hole 94 and the round hole 95.

Figure 10:
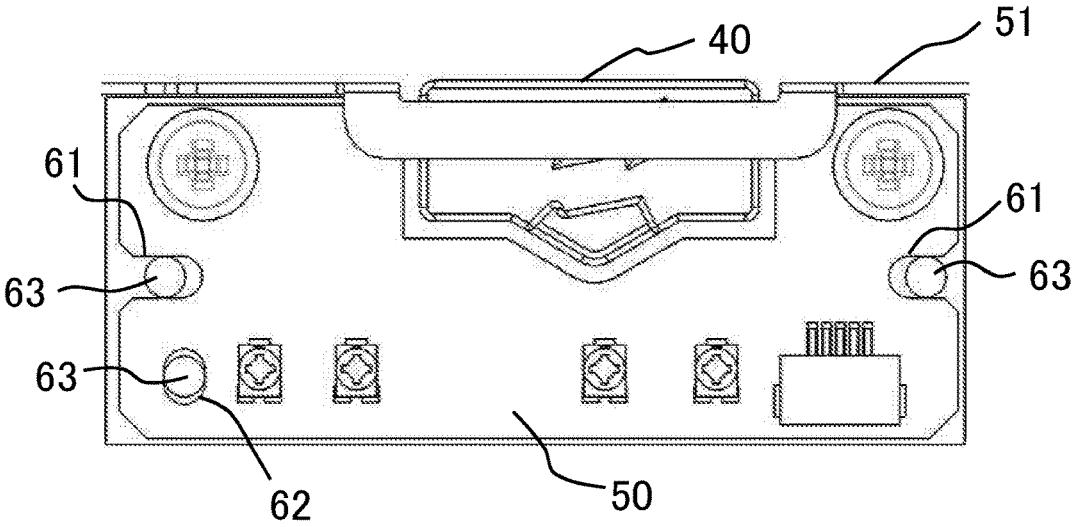
FIG. 10 is a front view of a board for explaining a positioning method of a board in an image forming apparatus of an embodiment.
Figure 11:
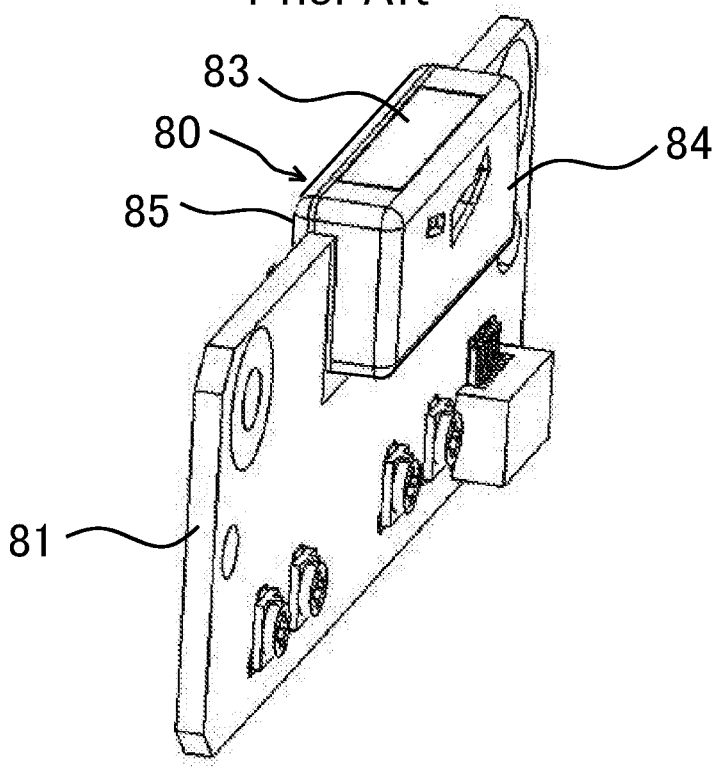
Fig.11 Prior Art
FIG. 11 is a perspective view of an ID sensor in a related image forming apparatus.
Figure 12:
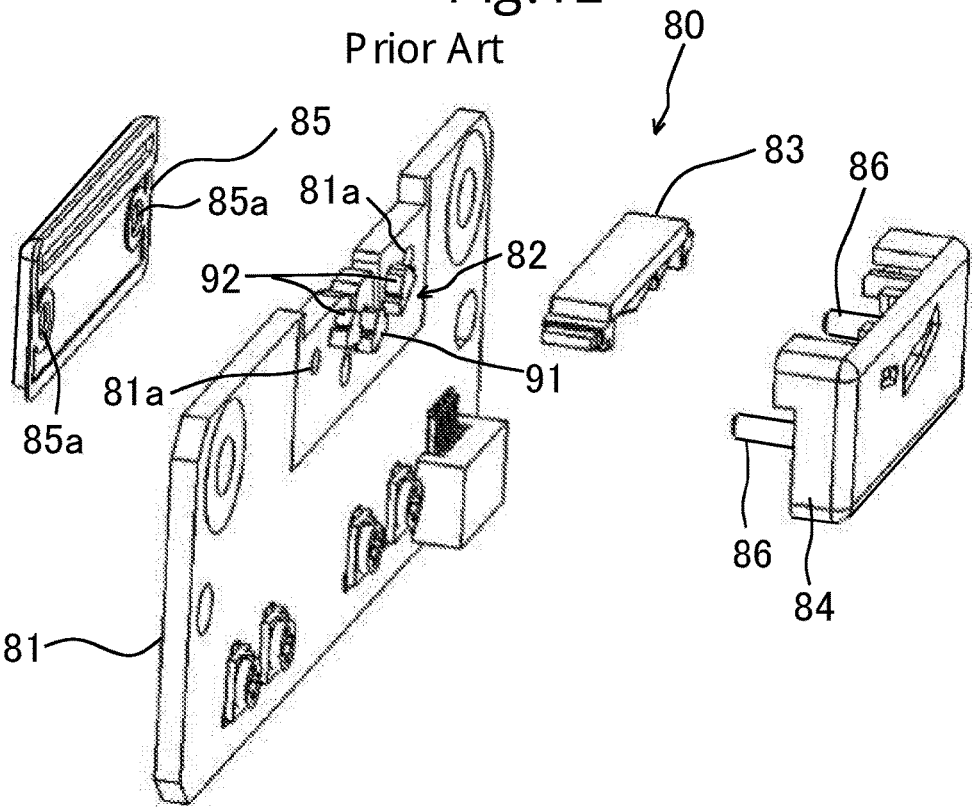
Fig.12 Prior Art
FIG. 12 is an exploded perspective view of an ID sensor in a related image forming apparatus.
Figure 13:
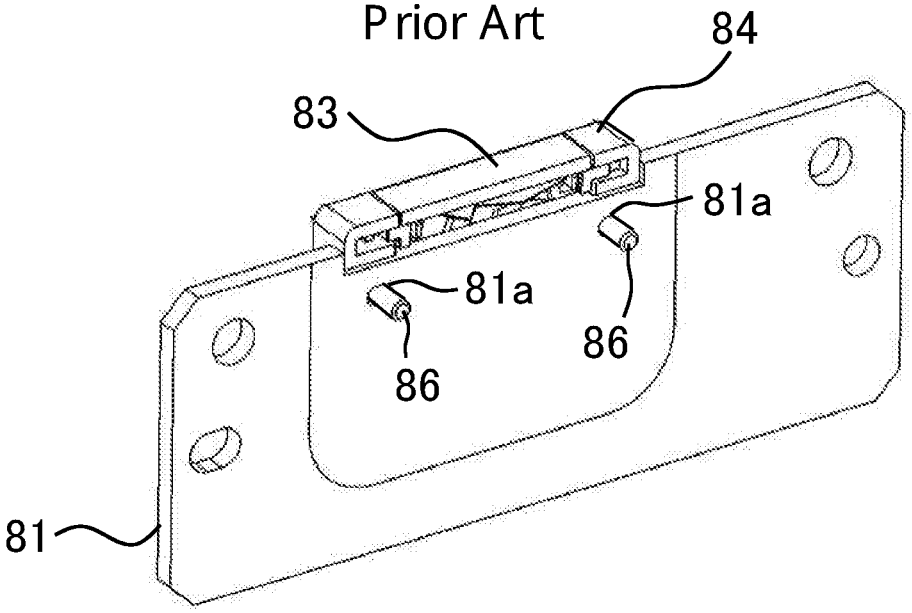
Fig.13 Prior Art
FIG. 13 is a perspective view of a state in which pins of a holding member are allowed to be inserted into through holes of a board in a related image forming apparatus.
Figure 14:
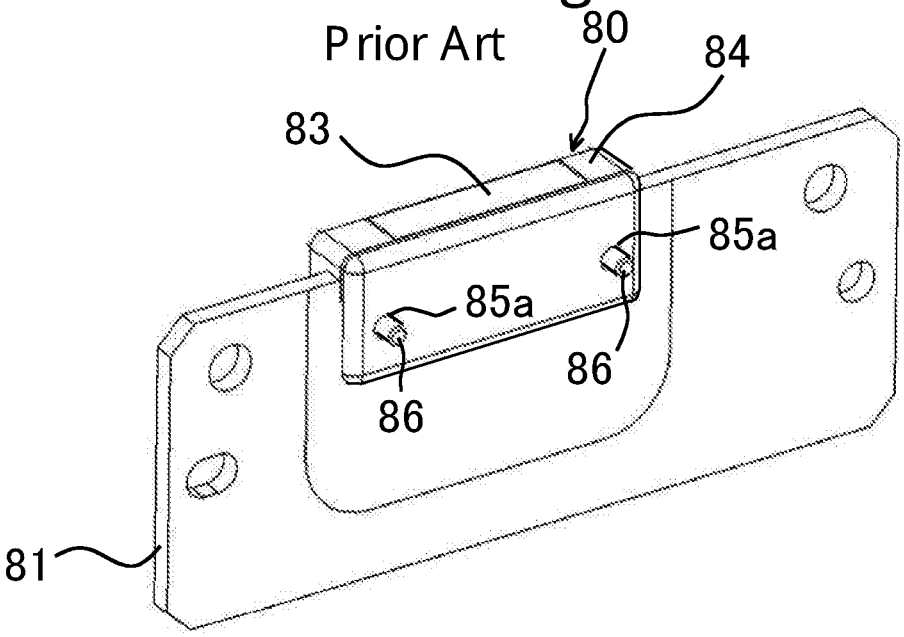
Fig.14 Prior Art
FIG. 14 is a perspective view of a state in which pins of a holding member are allowed to be inserted into through holes of a lid member in a related image forming apparatus.

In contrast, in the present embodiment, as illustrated in FIG. 10, as described above, the board 50 is formed with a pair of notches 61 extending in parallel to the upper end surface of the board 50 from each of sides facing each other. The heights of lower ends of the pair of notches 61 are equal to each other. In the case of fixing the board 50 to the support member 51, in the state in which a columnar boss 63 (a protrusion) has been allowed to be inserted into each notch 61, an operator pushes down the board 50 to achieve down-shift, restricts the vertical movement of the board 50 by the pair of notches 61, and performs screwing. In this way, the board 50 is fixed in the state in which its upper end surface is horizontal.

When confirming whether the down-shift is achieved after the screwing, a thickness gauge is used. In the present embodiment, the thickness gauge is put into the notch 61 from the side face side of the board 50, so that it is possible to confirm whether the down-shift is achieved. When the thickness gauge is put into the notch 61, since the down-shift is not achieved, the screwing work is performed again.

When the related round hole 95 is changed to the notch 61, the transverse positioning of the board 50 cannot be achieved. Therefore, the board 50 is formed with the long hole 62 extending in the vertical direction. The long hole 62 is formed in the vicinity of one corner part of the lower side of the board 50. The aforementioned down-shift is performed in the state in which the boss 63 has also been inserted into the long hole 62, so that the transverse movement of the board 50 is restricted by the long hole 62 and the long hole 62 is also screwed.

Other Embodiments

In the aforementioned embodiment, the number of the board pins 55*a* is 2; however, the embodiment is not limited thereto and the number of the board pins 55*a* may be 3 or more. Furthermore, the arrangement of the board pins 55*a* is not limited to the aforementioned embodiment and other arrangements may also be employed.

In the aforementioned embodiment, the number of the cover pins 55*b* is 3; however, the embodiment is not limited thereto and the number of the cover pins 55*b* may be 2 and may be 4 or more. Furthermore, the arrangement of the cover pins 55*b* is not limited to the aforementioned embodiment and other arrangements may also be employed.

In the aforementioned embodiment, the notch 61 and the long hole 62 are used in the positioning of the board 50; however, the embodiment is not limited thereto and similarly to the related art, the positioning of the board 50 may be performed by a long hole and a round hole.

What is claimed is:

1. An image forming apparatus, which includes a plurality of rotational image carrying members and an intermediate transfer belt rotating in a state of abutting on each of the plurality of image carrying members and forms a color image by transferring a toner image formed on a surface of each of the plurality of image carrying members to the intermediate transfer belt and transferring the toner image transferred onto the intermediate transfer belt onto a transfer material, comprising:

an ID sensor arranged to face the intermediate transfer belt; and a board provided with the ID sensor, wherein the ID sensor is integrally formed with the board, and while emitting light toward the intermediate transfer belt, the ID sensor includes a sensor body that individually receives light regularly reflected and light diffused and reflected by the intermediate transfer belt, a lens that is arranged between the sensor body and the intermediate transfer belt to control emitted light from the sensor body and incident light to the sensor body, and a holding member that holds the lens, the holding member is directly welded and fixed to the board, the image forming apparatus further comprises a lid member arranged at an opposite side of the holding member while interposing the board between the lid member and the holding member and forming a box body for receiving the holding member and the sensor body therein, and the lid member is directly welded and fixed to the holding member at three places or more.

2. An image forming apparatus, which includes a plurality of rotational image carrying members and an intermediate transfer belt rotating in a state of abutting on each of the plurality of image carrying members and forms a color image by transferring a toner image formed on a surface of each of the plurality of image carrying members to the intermediate transfer belt and transferring the toner image transferred onto the intermediate transfer belt onto a transfer material, comprising:

an ID sensor arranged to face the intermediate transfer belt; and a board provided with the ID sensor, wherein the ID sensor is integrally formed with the board, and while emitting light toward the intermediate transfer belt, the ID sensor includes a sensor body that individually receives light regularly reflected and light diffused and reflected by the intermediate transfer belt, a lens that is arranged between the sensor body and the intermediate transfer belt to control emitted light from the sensor body and incident light to the sensor body, and a holding member that holds the lens, the holding member is directly welded and fixed to the board, the image forming apparatus further comprises a support member to which the board is erectly fixed, the board has a pair of notches extending in a transverse direction from each of sides facing each other and a long hole extending in a vertical direction, and the board is fixed to the support member by bosses inserted into the pair of notches and the long hole.

* * * * *